US005511396A

United States Patent [19]

Kim et al.

[11] Patent Number: 5,511,396

[45] Date of Patent: Apr. 30, 1996

[54] LOW FREQUENCY VIBRATION TYPE WASHING MACHINE

[75] Inventors: Jung C. Kim, Seoul; Dong Y. Oh; Gyu S. Choe, both of Kyungki-do; Kyung S. Hong, Inchon-Jikhalsi; Kyung H. Kim, Seoul; Joo H. Lee; Ha I. Lee, both of Kyungki-do; Kyeong B. Park, Seoul; Dong S. Gil, Seoul; Oh H. Kwon, Seoul; Byoung H. Kwon, Busan-Jikhalsi, all of Rep. of Korea

[73] Assignee: Goldstar Co., Ltd., Seoul, Rep. of Korea

[21] Appl. No.: 249,577

[22] Filed: May 26, 1994

[30] Foreign Application Priority Data

| | | | |
|---|---|---|---|
| May 29, 1993 | [KR] | Rep. of Korea | 9447/1993 |
| Jun. 7, 1993 | [KR] | Rep. of Korea | 10226/1993 |
| Jun. 9, 1993 | [KR] | Rep. of Korea | 10461/1993 |

[51] Int. Cl.[6] ..... D06F 17/08

[52] U.S. Cl. ..... 68/3.055; 68/133; 134/197

[58] Field of Search ..... 366/275, 112, 366/276, 277, 332, 112; 68/133, 355; 134/196, 197

[56] References Cited

U.S. PATENT DOCUMENTS

| | | | |
|---|---|---|---|
| 560,528 | 5/1896 | Obermeyer | 366/267 |
| 852,720 | 5/1907 | Hiss | 366/332 X |
| 1,384,876 | 7/1921 | Voss | 366/332 X |
| 1,408,596 | 3/1922 | Heinrich | 366/332 |
| 1,718,115 | 6/1929 | Covert | 366/267 |
| 1,838,595 | 12/1931 | Turner | 366/332 |
| 1,881,851 | 10/1932 | Moussette, Sr. | 366/332 X |
| 2,084,546 | 6/1937 | Ahlmann | 366/267 X |
| 2,446,750 | 8/1948 | Ferris | 366/332 X |
| 2,471,876 | 5/1949 | Kuhn | 366/332 X |
| 2,618,217 | 11/1952 | Minda et al. | 366/275 |
| 4,732,487 | 3/1988 | Pollard . | |

FOREIGN PATENT DOCUMENTS

| | | | |
|---|---|---|---|
| 476181 | 10/1927 | Germany | 366/267 |

*Primary Examiner*—Frankie L. Stinson

*Attorney, Agent, or Firm*—Finnegan, Henderson, Farabow, Garrett & Dunner

[57] ABSTRACT

A low frequency vibration type washing machine has an oscillating disc suitable for both generation of an effective circulation current in the multi-phase washing medium and prevention of energy loss. The oscillating disc vertically vibrates in the multi-phase washing medium in the washing tub at different ascending and descending velocities, thus to generate an effective circulation current in the multi-phase washing medium. A plurality of perforations are formed in the oscillating disc for both reduction of the washing medium resistance and generation of the effective circulation current in the washing medium. The washing machine also has an elastic body mounted on the oscillating disc for preservation of vibration energy loss of the washing medium in the form of elastic energy. The washing tub is preferably rounded at its inner bottom corner and at its inner bottom center about the disc drive shaft penetrating the bottom center.

2 Claims, 5 Drawing Sheets

LOW FREQUENCY VIBRATION TYPE WASHING MACHINE

BACKGROUND OF THE INVENTION

1. Field of the Invention

The present invention relates in general to automatic washing machines using low frequency vibration in clothes washing and, more particularly, to an improved structure in low frequency oscillating discs of such washing machines for both generation of strong circulation currents suitable for improvement of the washing effect and prevention of vibration energy loss of the water.

2. Description of the Prior Art

In order to wash clothes in a conventional automatic washing machine using low frequency vibration, a low frequency oscillating disc placed in a washing tub generates a specified low frequency vibration which causes resonance phenomena in a multi-phase washing medium in the washing tub. Here, the multi-phase washing medium consists of water, detergent and air. The level of low frequency is specified in accordance with shape the of the washing tub, the shape of the oscillating disc and the mixing ratio of the multi-phase washing medium.

In the above washing machine, the desired mechanical washing effect is achieved by the micro air bubbles generated by cavitation of the oscillating disc or nonlinear vibration. Both the cavitation and the nonlinear vibration are generated in the multi-phase medium at the same time of generation of the resonance phenomena. The mechanical washing effect caused by the cavitation or the nonlinear vibration cooperates with a chemical washing effect caused by the detergent in the washing medium, thus to achieve the desired washing effect.

With reference to FIG. 1, there is shown a typical automatic washing machine using the low frequency vibration. The washing machine generally comprises a washing tub 1, receiving a multi-phase washing medium therein, and a low frequency oscillating disc 4 causing the resonance phenomena in the washing medium. The oscillating disc 4 is placed in the washing tub 1 and coupled to an actuator 2 through a shaft 3. The shaft 3 transmits the drive force of the actuator 2 to the disc 4 so as to drive this disc 4. The actuator 2, which is mounted on the outer bottom of the washing tub 1, is applied with an amplitude signal and a frequency signal from a signal oscillator 7. A signal amplifier 8 is placed on a line between the actuator 2 and the signal oscillator 7 for amplifying and varying the signals generated by the signal oscillator 7.

There is provided a gap between the inner bottom of the washing tub 1 and the disc 4 for allowing the disc 4 to vertically vibrate. A lid 9 is provided in the opening of the washing tub 1 for hermetically covering the opening.

In operation of the above washing machine, the low frequency oscillating disc 4 is driven by the actuator 2 in response to signals applied from the signal oscillator 7 to the actuator 2 through the signal amplifier 8. This disc 4 thus oscillates in order to cause the resonance phenomena in the multi-phase washing medium in the washing tub 1. Here, the desired mechanical washing effect is achieved by the micro air bubbles generated by cavitation of the oscillating disc or nonlinear vibration, which cavitation and nonlinear vibration are generated in the multi-phase medium at the same time of generation of the resonance phenomena. The above mechanical washing effect cooperates with the chemical washing effect caused by the detergent in the washing medium, thus to achieve the desired washing effect.

In the above clothes washing using the low frequency vibration, the signal oscillator 7 makes the oscillating disc 4 oscillate in an oscillation frequency band of 20–250 Hz, an amplitude band of 2–25 mm and a rotational amplitude band of 2°–10°. Here, the signal amplifier 8 amplifies current signals or voltage signals which are to be applied from the signal oscillator to the actuator 2.

It has been noted that the above washing machine has the following problems.

Since the oscillating disc 4 simply vibrates at a predetermined frequency in the washing medium in the washing tub 1 so as to vibrate the washing medium and to cause a water current in the washing medium, this disc 4 only causes a weak water current. In this regard, large clothes may fall to be circulated in the washing medium but simply may lie in the bottom of the washing tub 1 due to their own weight. The clothes also may be jammed in the gap between the oscillating disc 4 and the inner bottom of the washing tub 1. When the clothes lie in the bottom of the washing tub 1 and are jammed in the gap as described above, the washing effect of the washing machine will be deteriorated.

The conventional disc 4 has a simple circular disc structure and this makes the circulation current mainly generated about the gap between the simple disc 4 and the inner bottom of the washing tub 1. Such a partial generation of the circulation current causes the disc 4 to be applied with strong water resistance. In addition, a large amount of power will be required for vibrating the disc 4 to a level achieving the desired washing effect. This directly runs counter to the recent trend of seeking energy savings.

In clothes-washing of the above washing machine, the washing medium, which was transmitted with the vibration energy from the oscillating disc 4, bumps against the disc 4 and loses its internal energy or the vibration energy. Hence, the washing medium should be provided with new direction and new velocity for its motion. In order to provide the new direction and new velocity of motion for the washing medium, the disc 4 will be attended with additional kinetic energy loss.

SUMMARY OF THE INVENTION

It is, therefore, an object of the present invention to provide a low frequency vibration type washing machine in which the aforementioned problem of the conventional washing machine can be overcome and of which the oscillating disc generates an effective circulation current such as, a heart type circulation current or a circular circulation current, in the multi-phase washing medium in the washing tub and prevents waste of energy, which energy is applied from the disc to the washing medium for causing the resonance phenomena in the washing medium.

In order to accomplish the above object, a low frequency vibration type washing machine in accordance with an embodiment of the present invention comprises a washing tub, an oscillating disc vertically vibrating in a multi-phase washing medium in the washing tub at different ascending and descending velocities, thus to generate an effective circulation current in the multi-phase washing medium, a plurality of perforations formed in the disc for both reduction of the washing medium resistance and generation of the effective circulation current in the washing medium, and elastic means for preservation of vibration energy loss of the washing medium in the form of elastic energy.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
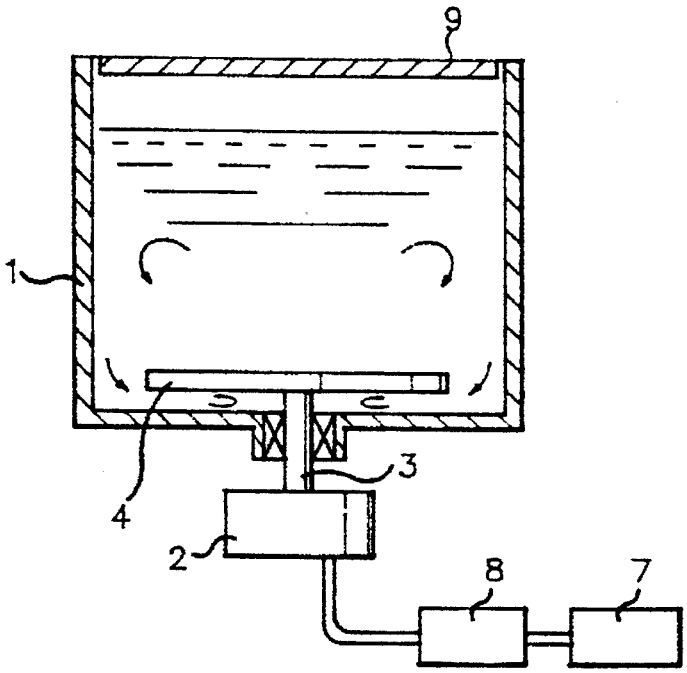
FIG. 1 PRIOR ART
FIG. 1 is a sectional view of a typical washing machine using a low frequency vibration in its washing operation.

In the following description, those elements common to both the embodiments of this invention and the prior art embodiment of FIG. 1 will carry the same reference numerals.

Figure 2:
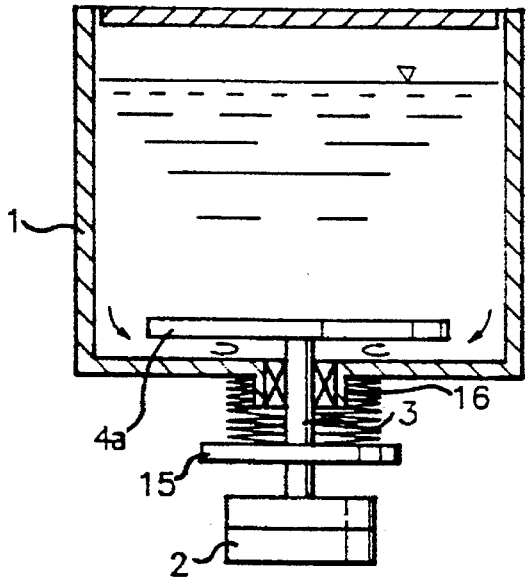
FIG. 2 is a sectional view of a low frequency vibration type washing machine having a low frequency oscillating disc generating a heart type circulation current in a multi-phase washing medium in accordance with an embodiment of the present invention.

With reference to FIG. 2, there is shown a low frequency vibration type washing machine having an oscillating disc in accordance with a primary embodiment of the present invention. The washing machine is provided with disc velocity control means for making the ascending and descending velocities of the disc different from each other. The velocity control means of the primary embodiment comprises biasing means or a compression coil spring 16 which is placed between a flange 15 and the outer bottom of the washing tub 1. The flange 15 is mounted on the drive shaft 3 extending between the oscillating disc 4*a* and the actuator 2.

In vertical vibration of the oscillating disc 4*a*, the coil spring 16 is compressed during ascending of the disc 4*a* in the multi-phase washing medium. Hence, the coil spring 16 generates a spring force for disturbing the ascending of the disc 4*a*, so that the load applied to the actuator 2 is increased. However, when the disc 4*a* descends from its top dead center, the compressed spring 16 returns to its original position due to its restoring force. This generates a force tending to push down the disc 4*a* and reduces the load of the actuator 2. Therefore, the descending velocity of the disc 4*a* is higher than its ascending velocity.

In use of an electric motor or a linear motor as the drive means of the actuator 2 the load of the actuator 2 is in inverse proportion to the velocity of the actuator 2. That is, the higher load applied to the actuator 2, the more slowly the actuator 2 moves while the lower the applied to, the faster the actuator 2 moves. The low frequency vibration type washing machine of the present invention is provided with the compression coil spring 16 which is mounted on the drive shaft 3 of the actuator 2. The spring 16 is placed between the flange 15 and the outer bottom of the washing tub 1. With the coil spring 16, the load of the actuator 2 is increased when the disc 4*a* is lifted up while it is reduced when the actuator 2 is downed. Hence, the descending velocity of the disc 4*a* is higher than the ascending velocity of the disc 4*a*.

Figure 3:
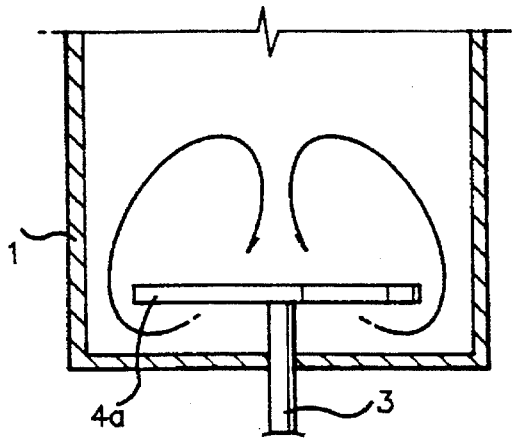
FIG. 3 is a sectional view of the washing machine of FIG. 2, showing the operational effect of the oscillating disc.

Since the descending velocity of the disc 4*a* is higher than the ascending velocity of the disc 4*a* as described above, the disc 4*a* weakly forces up the washing medium during its lower velocity ascending. However, when descending at a higher velocity, the disc 4*a* strongly forces the washing medium out of the gap between the disc 4*a* and the inner bottom of the washing tub 1 simultaneously with strongly trailing the washing medium on its top surface. When the disc 4*a* descends at the higher velocity, the washing medium should be thus strongly forced out of the narrow gap between the descending disc 4*a* and the inner bottom of the washing tub 1. The washing medium, thereafter, ascends along the inner side surface of the washing tub 1. At this time, the descending disc 4*a* also strongly trails the washing medium on its top surface. There is thus generated the desired heart type circulation current in the washing medium as shown at the arrows of FIG. 3. This heart type circulation current improves the washing effect.

Figure 4:
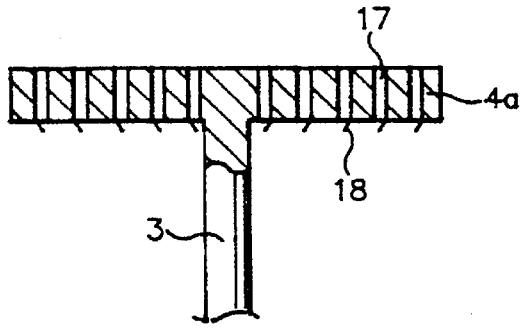
FIG. 4 is a sectional view of a perforated oscillating disc of a washing machine in accordance with another embodiment of the present invention.

FIG. 4 shows an oscillating disc in accordance with a second embodiment of the present invention. In this second embodiment, the disc 4*a* is vertically perforated for forming the disc velocity control means. The vertical perforations 17 of the disc 4*a* are provided with their check valves 18 at their bottom ends. The check valves 18 let the washing medium pass through their perforations 17 in one direction.

With the perforations 17 and their check valves 18, the washing medium on the top surface of the disc 4*a* flows downward through the perforations 17 during ascending of the disc 4*a*, thus to make the disc 4*a* ascending at higher velocity. However, the check valves 18 block their perforations 17 during descending of the disc 4*a*, so that the bottom surface of the descending disc 4*a* is applied with considerable water resistance. In this regard, the descending velocity of the disc 4*a* should be reduced. Therefore, the perforated disc 4*a* of this second embodiment can be controlled in its ascending and descending velocities without use of the spring 16 of the primary embodiment. The perforated disc 4*a* thus generates the strong circulation current or the heart type circulation current during its vertical vibration as described for the primary embodiment.

Figure 5:
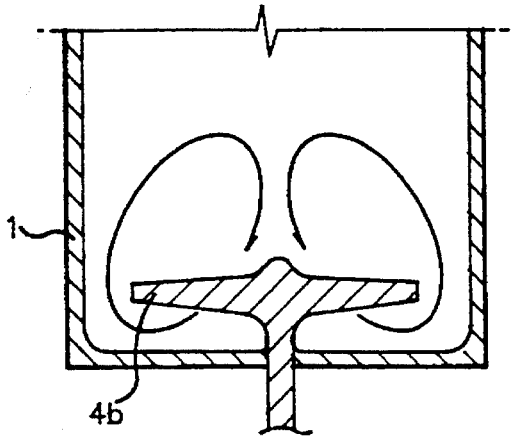
FIG. 5 is a view corresponding to FIG. 2, but showing still another embodiment of the present invention.

Turning to FIG. 5 there is shown a washing machine having an oscillating disc in accordance with a third embodiment of the present invention. The disc 4*b* of this third embodiment has a generally conical profile when cross sectioned. That is, the top and bottom surfaces of the disc 4*b* slope down from the center to the edge, so that the center of the disc 4*b* is thicker than the edge. In addition, the inner bottom corner of the washing tub 1 is rounded. In the same manner, the inner bottom center of the washing tube 1 about the drive shaft 3 is rounded.

When the disc 4*b* is lifted up in the washing medium during its vertical vibration, the washing medium on the top center of the disc 4*b* flows down to the edge of the disc 4*b*.

However, when the disc 4b descends during its vertical vibration, the washing medium in the gap between the disc 4b and the inner bottom of the washing tub 1 smoothly flows out of the gap along the sloping bottom surface of the disc 4b. The washing medium flowing out of the gap in turn ascends from the rounded inner bottom corner of the washing tub 1. There is thus generated the desired heart type circulation current in the washing medium in the washing tub 1 as shown at the arrows of FIG. 5.

Figure 6A:
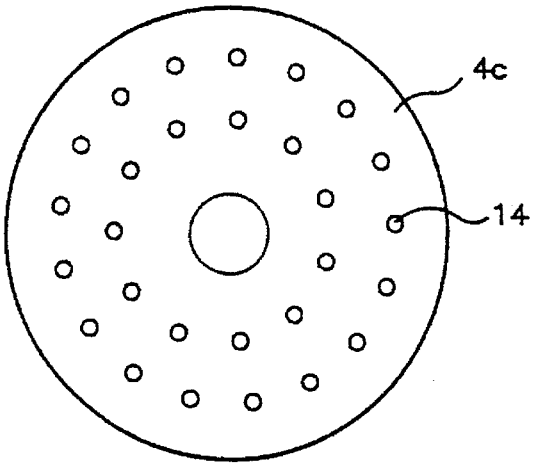
FIGS. 6*a* to 9*b* are plan views and sectional views of perforated oscillating discs, which discs generate the heart type circulation current in the washing medium simultaneously while preventing waste of energy of the washing medium, in accordance with other embodiments of the present invention respectively.
Figure 7A:
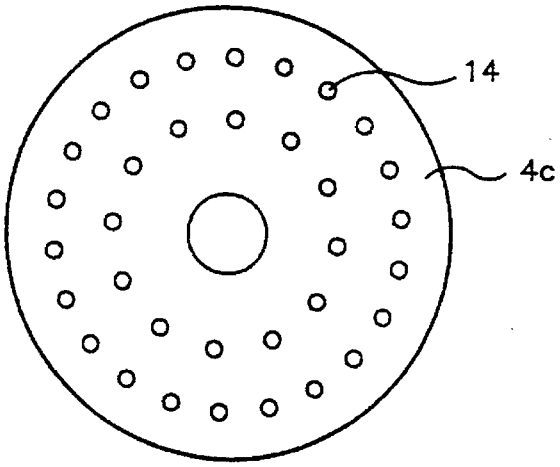
Figure 6B:
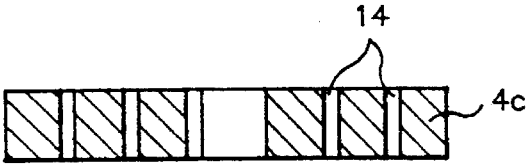
Figure 7B:
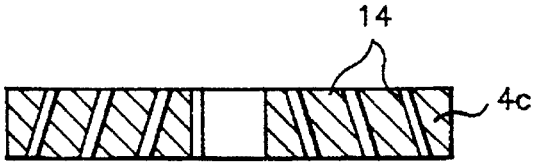

FIGS. 6a and 7a show oscillating discs in accordance with fourth and fifth embodiments of the present invention respectively. The discs 4c of the fourth and fifth embodiments are perforated respectively so as to not only generate the desired heart or circular type circulation current in the washing medium but also prevent waste of vibration energy of the washing medium. The vibration energy was applied from the disc to the washing medium for generation of the resonance phenomena. The disc 4c of the fourth embodiment is vertically perforated so as to form a plurality of vertical perforations 14 as shown in FIG. 6b. However, the perforations 14 of the disc 4c of the fifth embodiment are inclined with respect to the drive shaft 3 at an inclination angle as shown in FIG. 7b. Here, it is preferred to set the inclination angles of the perforations 14 to 15°–75°. When the inclination angles of the perforations 14 are set as described above, the perforated disc 4c generates during its vertical vibration a desirable circulation current suitable for achieving the desired washing effect. Such perforations 14 for generating the desired heart or circular type circulation current in the washing medium and preventing waste of vibration energy of the washing medium may be adapted to a conventional disc or selectively adapted to the discs 4a and 4b of FIGS. 3 to 5.

Figure 10:
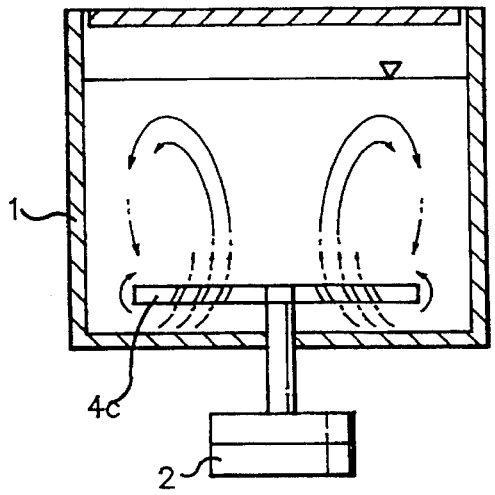
FIG. 10 is a sectional view of the washing machine having one of the perforated oscillating discs of FIGS. 6*a* to 9*b*, showing the operational effect of the discs.

When the perforated disc 4c of FIG. 6a or 7a oscillates the washing medium in the washing tub 1 during its vertical vibration, the washing medium flows through the gap between the disc 4c and the inner bottom of the washing tub 1 simultaneously with flowing through the perforations 14 of the disc 4c. Especially, when the disc 4c descends, the washing medium flows upward at a higher velocity as shown at the arrows of FIG. 10.

Such a current of the washing medium caused by the structures of the perforated discs 4c of FIGS. 6a and 7a reduces the water resistance which will be applied from the washing medium to the discs 4c during the vertical vibration of the discs 4c, thereby saving the power for driving the discs 4c. The above current flowing through the perforations 14 of the discs 4c causes the desired circular or heart type circulation current in the washing medium. This prevents the clothes from jamming into the gap between the disc 4c and the inner bottom of the washing tub 1 and causes the clothes to be smoothly circulated in the washing medium so as to be washed.

It should be understood that the size of the perforations 14 is designed in consideration of the thickness of the disc 4c. That is, when letting the thickness of the disc 4c be "t" and letting the diameter of each perforation 14 be "d", it is preferred to make the ratio of the thickness "t" to the diameter "d" higher than 2, that is, $t/d>2$. When $t/d>2$, the disc 4c effectively generates the desired resonance phenomena in the washing medium and, at the same time, uses a small amount of power. This achieves the desired washing effect simultaneously while saving of the energy. For example, when the thickness of the disc 4c is ranged from 8 mm to 30 mm, it is preferred to set the diameter of the perforations 14 to 4–15 mm.

Figure 8A:
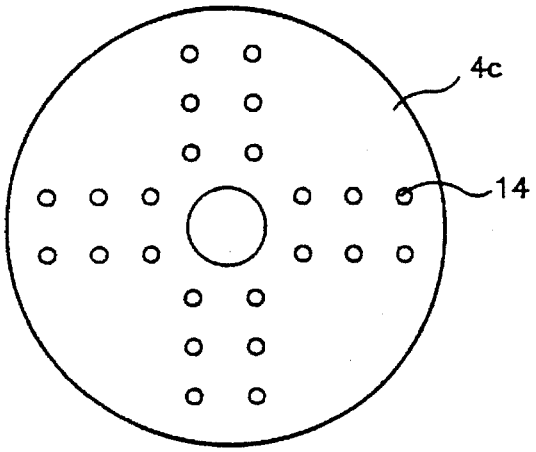
Figure 9A:
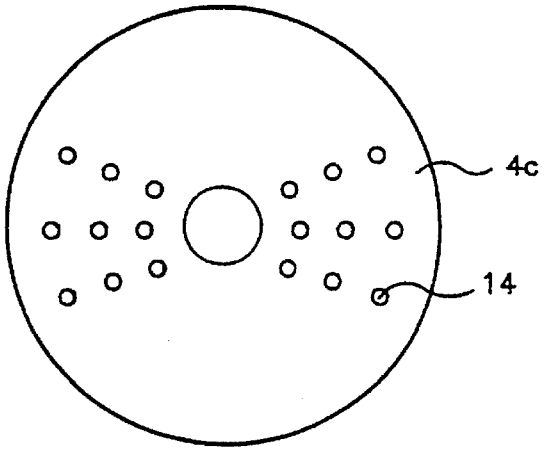
Figure 8B:
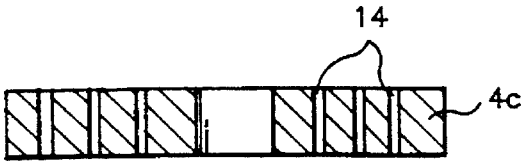
Figure 9B:
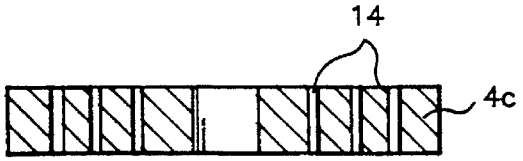

Turning to FIGS. 8a and 9a, there are shown arrangements of the perforations 14 of the discs 4c in accordance with other embodiments of the present invention respectively. FIGS. 8b and 9b are cross sectional views of the discs of FIGS. 8a and 9a respectively. As shown in FIG. 8a, the perforations 14 may be radially arranged on the discs 4c such that they are spaced out at regular angle intervals or 90° angle intervals. That is, two rows of perforations 14 may be radially arranged on the disc 4c at every 90°. Alternatively, the perforations 14 may be symmetrically arranged on the disc 4c as shown in FIG. 9a. That is, the perforations 14 may be formed in the right and left sectors of the disc 4c while no perforation is formed in the upper and lower sectors of the disc 4c. As a further alternative, the perforations 14 may be irregularly arranged on the disc 4c such that they are asymmetrical. Each perforation 14 may be tapered such that the diameters of its top and bottom ends are different from each other. In addition, the perforations 14 may be not rounded or circular sectioned but cornered.

Figure 11:
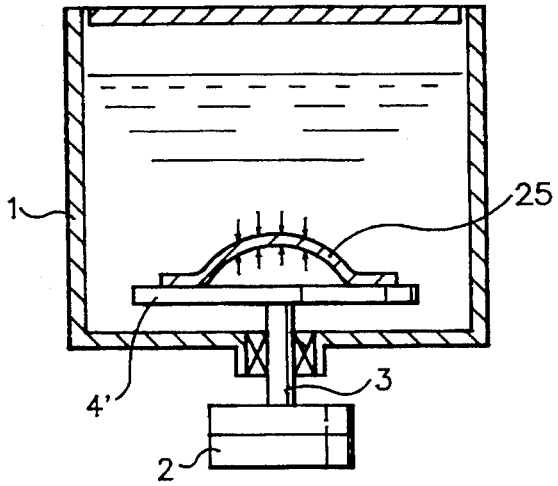
FIGS. 11 and 12 are sectional views of washing machines having oscillating discs, which discs prevent waste of vibration energy of the washing medium, in accordance with further embodiments of the present invention respectively.

FIG. 11 shows a washing machine having an oscillating disc, which disc is suitable for prevention of waste of energy of the washing medium, in accordance with the sixth embodiment of the present invention. The oscillating disc 4' of this embodiment includes a domed elastic body 25 which is mounted on the upper surface of the disc 4'. This elastic body 25 absorbs the vibration energy loss of the washing medium and preserves the energy in the form of an elastic energy. Otherwise, the vibration energy of the washing medium, which energy was applied from the disc 4' to the washing medium for generation of resonance phenomena in the washing medium, will be simply lost during bumping of the washing medium against the disc 4'. The cavity defined between the domed elastic body 25 and the disc 4' is filled with fluid. The above structure of FIG. 11 for prevention of waste of energy may be adapted to a conventional disc or selectively adapted to the discs of FIGS. 2 to 10.

In vertical vibration of the oscillating disc 4' of FIG. 11, the disc 4' oscillates the washing medium in the washing tub 1, thus to give the vibration energy to the washing medium. When the washing medium having the vibration energy bumps against the disc 4', the vibration energy of the washing medium is absorbed by the elastic body 25 defining the cavity filled with gas or liquid. The vibration energy of the washing medium is thus preserved by the elastic body 25 as the elastic energy. This reduces the energy loss and complements the current of the washing medium. Such a complement of the current causes more effective generation of vibration in the washing medium.

Figure 12:
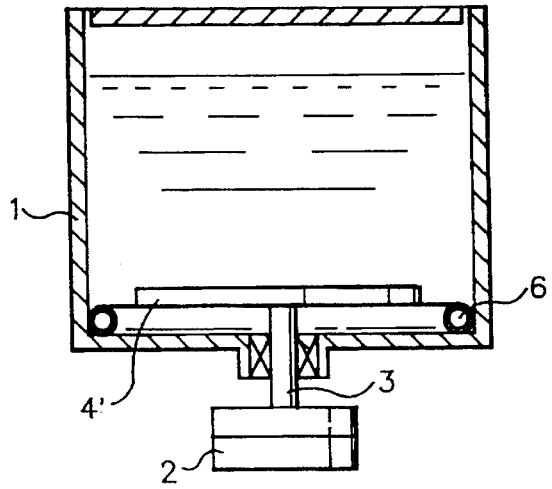

FIG. 12 shows an washing machine having an oscillating disc, which disc is suitable for prevention of waste of energy of the washing medium, in accordance with a further embodiment of the present invention. In this embodiment, a flexible tube 6 is mounted on the inner bottom of the washing tub 1 for prevention of energy loss. The flexible tube 6 is charged with fluid such as gas or liquid. The structure of the washing machine of FIG. 12 yields the same operational effect as that described for the sixth embodiment of FIG. 11 and further explanation is thus not deemed necessary. As described for the sixth embodiment, the structure of FIG. 12 for prevention of waste of energy may be adapted to a conventional disc or selectively adapted to the discs of FIGS. 2 to 10.

As described above, an oscillating disc of a low frequency vibration type washing machine in accordance with this invention generates an effective circulation current or a circular or heart type current in the multi-phase washing medium in the washing tub during its vertical vibration. This oscillating disc thus prevents the laundry clothes from lying in the bottom of the washing tub due to their own weight and from jamming into the gap between the disc and the inner bottom of the washing tub.

The oscillating disc may be also perforated so as to reduce the washing medium resistance applied to the disc during the vertical vibration of the disc. This saves the power for driving the disc.

With an elastic body, the disc of this invention absorbs the vibration energy loss of the washing medium and preserves the vibration energy in the form of an elastic energy. The disc is thus prevented from additional kinetic energy loss for supplying a to new direction and new velocity of motion of the washing medium.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A low frequency vibration type washing machine comprising:

a washing tub having a bottom wall;

an oscillating disc provided in said washing tub and vertically vibrating for generation of resonance phenomena in a multi-phase washing medium in said washing tub;

an external actuator joined to said oscillating disc by a disc drive shaft extending through said bottom wall for vibrating said oscillating disc; and disc velocity control means acting to cause descending velocities of said disc to be greater than ascending velocities of said disc, thereby generating a heart-shaped circulation of the washing medium in said tub, said velocity control means including a flange mounted on said disc drive shaft and a downward biasing means acting between said flange and said bottom wall of said washing tub.

2. The low frequency vibration type washing machine according to claim 1, wherein said biasing means is a compression coil spring.

* * * * *